US007191136B2

(12) United States Patent
Sinha et al.

(10) Patent No.: US 7,191,136 B2
(45) Date of Patent: Mar. 13, 2007

(54) EFFICIENT CODING OF HIGH FREQUENCY SIGNAL INFORMATION IN A SIGNAL USING A LINEAR/NON-LINEAR PREDICTION MODEL BASED ON A LOW PASS BASEBAND

(75) Inventors: Deepen Sinha, Chatham, NJ (US); Masoud Alghoniemy, Alexandria (EG); Lin Lin, Bridgewater, NJ (US); Alex Cabanilla, Middlesex, NJ (US)

(73) Assignee: iBiquity Digital Corporation, Warren, NJ (US)

( * ) Notice: Subject to any disclaimer, the term of this patent is extended or adjusted under 35 U.S.C. 154(b) by 814 days.

(21) Appl. No.: 10/261,454

(22) Filed: Oct. 1, 2002

(65) Prior Publication Data

US 2004/0064311 A1 Apr. 1, 2004

(51) Int. Cl.
*G10L 19/00* (2006.01)

(52) U.S. Cl. ..... 704/500; 704/205; 704/501

(58) Field of Classification Search ..... 704/205, 704/500, 501

See application file for complete search history.

(56) References Cited

U.S. PATENT DOCUMENTS 5,710,863 A * 1/1998 Chen ..... 704/219
6,680,972 B1 * 1/2004 Liljeryd et al. ..... 375/240

* cited by examiner

*Primary Examiner*—Richemond Dorvil
*Assistant Examiner*—Leonard Saint-Cyr
(74) *Attorney, Agent, or Firm*—Jones Day

(57) ABSTRACT

An efficient coding scheme with higher audio bandwidth and/or better audio quality at lower bitrates, wherein the scheme eliminates long-term and short-term frequency domain correlation in a signal via frequency domain predictors. The coding scheme compresses information consisting of coded low frequency components as well as a parametric representation for the high frequency components based on a non-linear model. Additionally, by working on the frequency domain representations of the signal (such as the MDCT representation which is naturally available to a PAC encoder and decoder), low pass and high pass signal components are easily obtained by windowing the appropriate ranges of frequencies in the signal. Furthermore, the power functions of the signal are replaced by corresponding convolution functions of the same order.

32 Claims, 7 Drawing Sheets

| Field | Abr. | # Bits | States | Processing | Condition |
|---|---|---|---|---|---|
| Mono | M | 1 | 0: stereo<br>1: mono | Decode one (mono) or two (stereo) channels but produce stereo outputs. | N/A |
| Huffman Scale Factor Lattice Quantization | Q | 1 | 0: non-lattice<br>1: lattice | Decode the Huffman Scale Factors using the lattice codebooks (1) or non-lattice codebooks (0). | N/A |
| Multi-dimensional (MD) Peaks | P | 1 | 0: non-MD Peaks<br>1: MD Peaks | Decodes the spectrum peaks using the MD Peaks codebook. | N/A |
| Prediction Mode | PM | 2 | 00: unused<br>01: recursive<br>10: non-recursive<br>11: spread/conv | The value indicates if high frequency prediction will be used and what method will be implemented. | N/A |
| Start Bin | SB | 2 | 00: 256/64<br>01: 384/80<br>10: 512/96<br>11: 640/112 | This field indicates at what frequency bin the high frequency prediction should begin. | PM > 0 |
| End Bin | EB | 2 | 00: 512/96<br>01: 640/112<br>10: 768/128<br>11: 1024/unused | This field indicates at what frequency bin the high frequency prediction should end. | PM > 0 |
| Residue Coding | R | 1 | 0: no residue<br>1: residue coding | Decode the high frequency residue if it has been included. | PM > 0 |
| Non-Linear Companding | N | 1 | 0: no companding<br>1: companding | | N/A |
| Upsampling | U | 1 | 0: no upsampling<br>1: upsampling | Indicates whether or not to upsample and compand the audio data. | N/A |
| Sequence # | SN | 2 | {0, 1, 2, 3} - 4:3<br>{0, 1} - 2:1 | A different sequence set exists for different upsampling ratios. | N/A |
| Expansion | X | 1 | 0: no more data<br>1: additional data | This bit provides a mechanism for future upgrades and backward compatibility. If the bit is set, it is interpreted to be the S bit. | N/A |
| Stereo High Frequency Coding | S | 1 | 0: no coding<br>1: stereo coding | This bit indicates that the high frequency content is stereo coded or monophonic coded. | X = 1 |
| HF Stability | H | 1 | 0: not stable<br>1: stable | Use only the stable parameters for the recursive prediction mode. | S = 1 |

Figure 6

EFFICIENT CODING OF HIGH FREQUENCY SIGNAL INFORMATION IN A SIGNAL USING A LINEAR/NON-LINEAR PREDICTION MODEL BASED ON A LOW PASS BASEBAND

FIELD OF INVENTION

The present invention relates generally to the field of digital signal processing. More specifically, the present invention is related to efficient coding of high frequency signal information.

BACKGROUND OF THE INVENTION

In prior art audio compression schemes, such as perceptual audio coding (PAC), audio is typically coded as the output of a filterbank. The filterbank provides a frequency or a time-frequency representation of the signal. Additionally, the filterbank outputs are quantized using a quantization function based on a psychoacoustic model, wherein the psychoacoustic model accounts for the non-linear frequency sensitivity of the human ear (destination) by using a non-linear frequency resolution (bark scale) in the quantizer. However, often there are non-linearities involved at the signal production stage (i.e., in the source), which result in interdependencies between the low and high frequency components of a signal. The linear filterbanks employed in PAC or similar codecs (e.g., modified cosine discrete transform (MDCT) and/or wavelets) are not capable of taking advantage of such redundancies in the signal which arise due to non-linearities at the signal production stage.

Furthermore, though the linear filterbank used in PAC or similar codecs (i.e., wavelet/MDCT) does a good job of de-correlating the signal in time domain, however, significant correlation often exists in the frequency domain representation of the signal. This correlation may be both short term (i.e., between samples located in adjacent frequency bins) and long term (i.e., between frequency bins which are far apart in frequency). This is particularly true for musical instruments and voiced speech which have a clearly defined harmonic structure. Thus, conventional audio coding schemes make little, if any, effort of taking advantage of this correlation.

Furthermore, in prior art PAC systems, several features, such as Huffman scale factor quantization or multidimensional peaks, had to be permanently selected or deselected prior to the system being deployed in the field. Additionally, the present invention's enhanced PAC algorithm incorporates techniques for efficient coding of higher frequency components in the signal. These techniques are often suitable for only a segment of higher frequencies. Furthermore, separate systems that incorporated PAC with differing preselected feature sets were not functionally interoperable.

High quality speech is produced via various coding techniques, one of which is code-excited linear prediction or CELP. The CELP coder is a model wherein the vocal tract and excitation is modeled via short-term synthesis filters, and the glottal excitation is modeled via long-term synthesis filters. Thus, the CELP encoder synthesizes speech via these short-term and long-term synthesis filters in a feedback loop.

A basic CELP coder is illustrated in FIG. 1. The long-term predictor is referred to as the pitch predictor, as its exploits the pitch periodicity in a speech signal. In prior art systems, a pitch predictor such as a one-tap pitch predictor is used, wherein the predictor transfer function (in the case of a one tap pitch predictor) is given by:

$$P_1(Z)=\Sigma\beta_Z Z^p$$

where p is the pitch period, and β is the predictor tap.

On the other hand, the short-term predictor (often referred to as linear prediction coding (LPC) predictor) is an $n^{th}$ order predictor with a transfer function of:

$$P_2(Z) = \sum^{n} \beta_z a_i Z^{-i}$$

wherein $a_1$ though $a_n$ are the predictor coefficients.

As illustrated in FIG. 1, the encoder first buffers the input signal 102 via a frame buffer 104, and long-tern predictor 106 and short-term predictor 108 perform linear predictive analysis and the resulting predictor parameters are quantized and encoded resulting in the output signal 112. It should be noted that the pitch predictor parameters are determined either via closed-loop or open-loop fashion.

SUMMARY OF THE INVENTION

The present invention provides for a method and a system that takes advantage of interdependencies between the higher frequency and lower frequency signal components that may arise due to non-linearities in signal production or because of a periodic harmonic structure. This results in a more efficient coding scheme than the prior art, which is therefore capable of generating higher audio bandwidth and/or better audio quality at lower bit rates. Long-term and short-term frequency domain correlation is eliminated in a signal via frequency domain predictors. The prediction efficiency can be potentially and adaptively increased with the help of a non-linear model. Thus, the present invention's coding scheme compresses information consisting of coded low frequency components (from a low pass filter with a cut-off frequency of $f_1$) as well as a parametric representation for the high frequency components (from a high pass filter with a cut-off frequency of $f_h$) based on a linear/non-linear model. The parametric representation requires significantly fewer bits than conventional coding of the higher frequency components. These parameters for the high frequency model representation are updated every audio frame.

Additionally, the present invention works in the frequency domain representations of the signal (such as the MDCT representation which is naturally available to the PAC encoder and decoder), wherein low pass and high pass signal components are easily obtained by windowing the appropriate ranges of frequencies in the signal. Furthermore, the power functions (in a non-linear model) of the signal are replaced by corresponding convolution functions in the frequency domain of the same order. Also, the model of the present invention can be adapted to different frequency bands (i.e., a separate set of model parameters can be estimated and transmitted for different frequency regions, thereby reducing the overall estimation error). Furthermore, the convolution operation adds less to the decoder complexity than the power function.

In an extended embodiment of the present invention, the high frequency component is represented as the model output plus a residual component, wherein the reconstruction error or residual R(f) is coded separately using the conventional PAC coding scheme. With a high degree of model fit, the resulting residual is significantly less complex to encode, thus requiring lesser number of bits to encode than the original high frequency component. The present invention also allows for compression mechanisms to be determined "on-the-fly" and transmitted via the header at playback time. The type of features which may be adaptively chosen include techniques such as lattice quantization of scale factors, multidimensional coding of the peaks, and selection of a frequency range most amenable towards efficient high frequency coding.

BRIEF DESCRIPTION OF THE DRAWINGS

FIG. 6 illustrates a table describing the functionality associated with the various fields in the header content of the bitstream.

DESCRIPTION OF THE PREFERRED EMBODIMENTS

Figure 1:
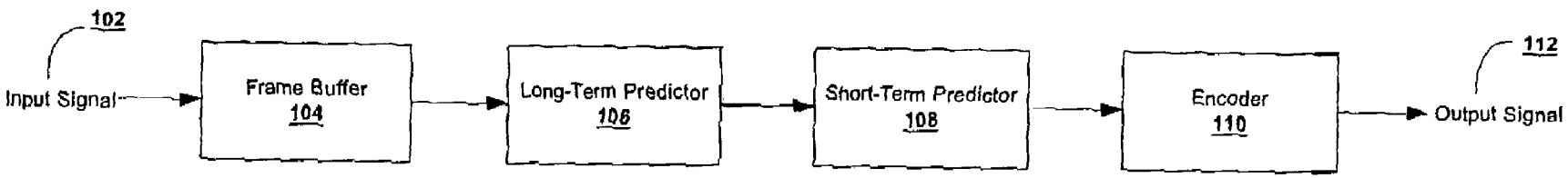
Prior Art Figure 1
FIG. 1 illustrates a prior art code excited linear predictor (CELP) coder.
Figure 2:
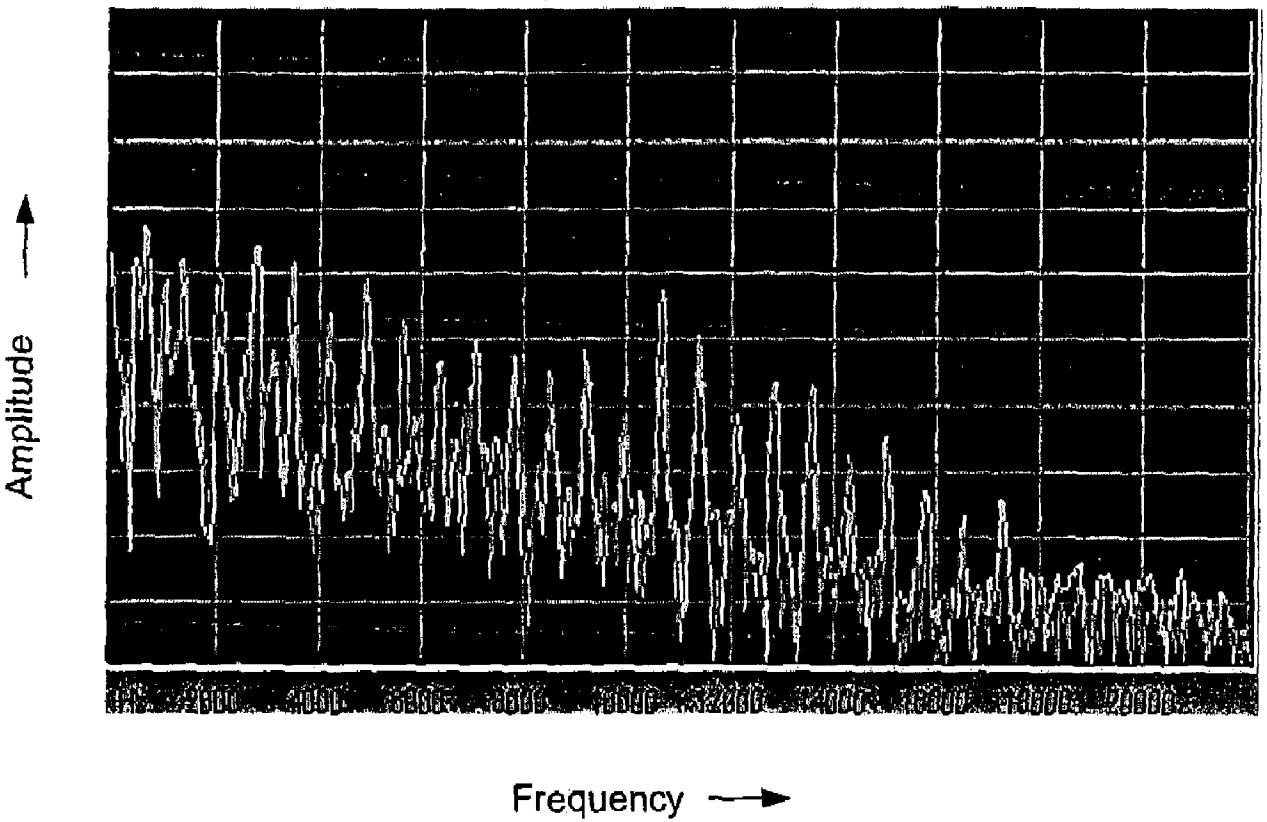
FIG. 2 illustrates a graph of signal with strong long-term frequency correlation.

As noted above, prior art systems make little effort to exploit the strong frequency domain correlation that is exhibited by many signals containing a strong harmonic structure. This aspect is illustrated in FIG. 2. Although, the signal has a very clearly defined harmonic structure with strong long-term frequency domain correlation (i.e., between any two harmonics), each harmonic is coded relatively independently in the prior PAC coding schemes (or similar codecs). In the present invention, both long term and short term correlation in the frequency domain representation of the signal is eliminated before encoding. It is most advantageous to eliminate such correlation from the high frequency components in the signal. The resulting "whitened" high frequency component can be efficiently coded using a substantially lower number of bits than the original high frequency components in the signal. The resulting codec allows for significantly higher audio bandwidth (e.g., 10 kHz at 20 kbps vs. 6 kHZ with conventional PAC) and/or improved quality at any bit rate.

In the present invention, long term and short term frequency domain correlation is eliminated in the signal with the help of frequency domain predictors. This is done for every audio frame (an audio frame in PAC consists of 1024 pulse code modulated (PCM) samples). The focus is primarily on the high frequency components of the signal, denoted as $X_{HFC}(f)$, and on inter-harmonic correlation removal. It should further be noted that the inter-harmonic correlation is eliminated with the help of a long-term prediction filter, such as a three-tap filter shown below:

$$R_{HFC}(f) = X_{HFC}(f) - \sum_{i=1}^{i=3} \beta_i X_{LFC}(f - M - i)$$

Figure 3:
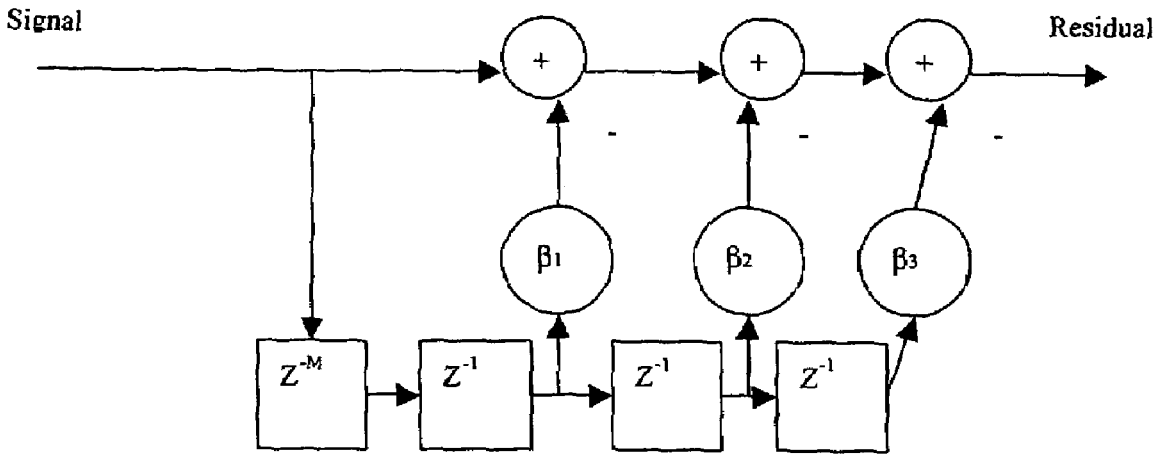
FIG. 3 illustrates a three-tap filter used in conjunction with the present invention.

In the above equation, $\beta_i$ represent the filter taps and M is the optimum correlation lag, i.e., the lag for which frequency components exhibit maximum inter-frequency correlation. This filter is illustrated in FIG. 3. $X_{LFC}$ is the low pass component of the signal and $R_{HFC}(f)$ is the resulting residual. Those skilled in the art will recognize that this structure is similar to the pitch predictor used in the code excited linear prediction (CELP) speech-coding algorithm. However, a key difference here is that this predictor is applied in the frequency domain unlike the CELP codec that uses long-term (pitch) prediction in the time domain.

The predictor taps $\beta_i$ ($\beta_1$, $\beta_2$, $\beta_3$ in case of the three-tap filter in FIG. 3) and the lag M are estimated using a two-step identification approach. First, the lag M is identified by searching for peak of the autocorrelation function in frequency. Next, the optimal predictor coefficients are estimated by solving a Yule Walker equation of the form:

$$\underline{R} \cdot \underline{a} = \underline{r}$$

The estimation of the optimal predictor coefficients is described in detail later in the specification.

In an enhancement to this scheme, the "whitened" high frequency residual may be further whitened using a conventional short-term predictor. The resulting residual may then even be modeled as Gaussian white noise and coded with the help of a random code-book. In a further enhancement to the above scheme, the high frequency components in the signal are modeled as being derivable from another signal(s) that is (are) obtained by applying non-linear processing to a low pass filtered version of the same signal (baseband). The nature of the non-linear processing and/or the dependency of the high frequency components on the non-linearly processed baseband are adaptively estimated on a frame-by-frame basis. The scheme therefore takes advantage of any interdependencies between the higher frequency and lower frequency signal components that may arise due to non-linearities in the signal production. This results in a more efficient coding scheme than the prior art, which is capable of generating higher audio bandwidth and/or better audio quality at lower bit rates.

Figure 4:
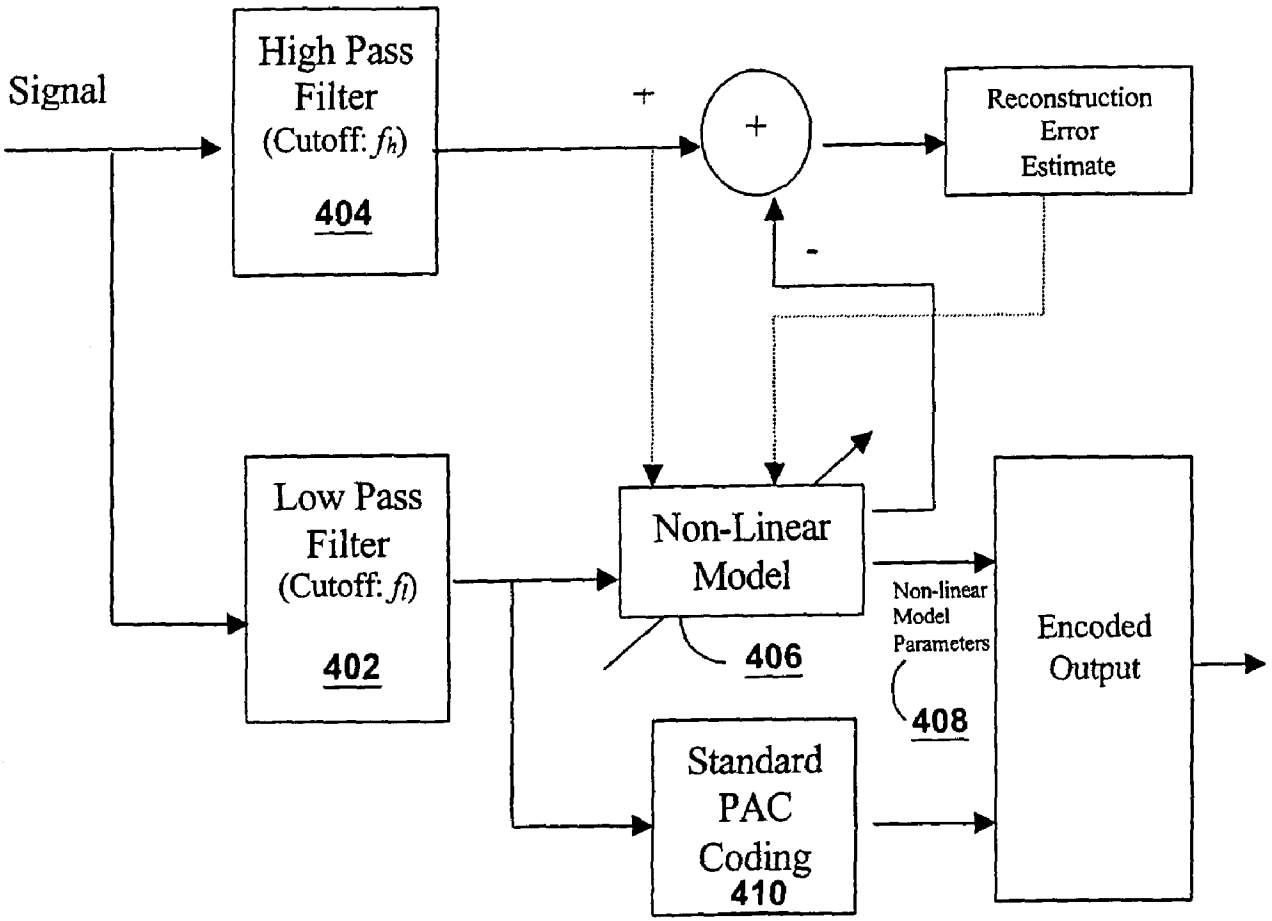
FIG. 4 illustrates the preferred embodiment of the present invention wherein long term and short term frequency domain correlation is eliminated in the input signal via frequency domain predictors.

The above-described enhancement of the present invention is outlined in FIG. 4. In this coding scheme the compressed information consists of coded low frequency components (from the low pass filter 402 with a cut-off frequency of $f_1$) as well as a parametric representation for the high frequency components (from the high pass filter 404 with a cut-off frequency of $f_h$): based on a non-linear model 406. The parametric representation requires significantly fewer bits than conventional coding of the higher frequency components. These parameters for the non-linear high frequency model representation are updated every audio frame (an audio frame in PAC typically consists of 1024 PCM samples). Next, the non-linear model parameters 408 estimated for the non-linear model 406 (using a method described below) are then combined with standard PAC coded output (via a PAC encoder 410) to form the encoded output of the audio signal.

In a practical coding scheme a convenient form for the non-linearity in FIG. 4 is desirable. In the present invention, a polynomial form is used for the non-linear processing. The polynomial form has the advantage that closed form expressions for the model parameters may be derived. Using this model the high frequency components in the signal, $x_{HFC}$, are modeled as a function of low frequency components, $x_{LFC}$, as below:

$$x_{HFC}(t) = \sum_{i=1}^{i=N} \alpha_i [x_{LFC}(t)]^i + R_{HFC}(f) \quad (1)$$

The parametric model description for high frequency components, therefore, consists of the order of the polynomial non-linearity N and the coefficients $\alpha_i$'s. For each frame of audio, one then needs to solve an identification problem to find optimal estimates for N and $\alpha_i$'s so that the model in equation (1) provides the best description for high frequency components in the signal (e.g., the power of reconstruction error, $R_{HFC}$ is minimized). A simple two-step solution to this identification problem works as follows. As mentioned above, for a fixed N, closed form expressions for optimal $\alpha_i$'s can be obtained by solving a set of matrix equation of the form $$\underline{R} \cdot \underline{a} = \underline{r} \quad (2)$$

where $\underline{R}=[R_{ij}]$, i=1, . . . N, j=1, . . . , N, and $R_{ij}=\langle[x_{LFC}(t)]^i \cdot [x_{LFC}(t)]^j\rangle$; $\underline{a}=[\alpha_1, \alpha_2, \ldots, \alpha_N]'$; and, $\underline{r}=[r_i]$, for i=1, . . . , N, and $r_i=\langle x_{HFC}(t) \cdot [x_{LFC}(t)]^i\rangle$. Therefore, for a given N, the above equation may be solved to obtain the set of optimal coefficients $\{\alpha_i\}$ and the corresponding minimum approximation error may then be computed. The model order N is obtained by examining the minimum approximation error over a small range of N and then choosing N for which the optimal approximation error is minimized.

In the development of proposed scheme it was further realized that it is advantageous to work with the frequency domain representations of the signal. In a frequency domain representation (such as the MDCT representation which is naturally available to the PAC encoder and decoder), low pass and high pass signal components are easily obtained by windowing the appropriate ranges of frequencies in the signal. Furthermore, the power functions in (1) are replaced by corresponding convolution functions of the same order. In other words if $X_{LFC}(f)$ and $X_{HFC}(f)$ denote the frequency transforms of $x_{LFC}(t)$ and $x_{HFC}(t)$ respectively, then equation (1) in frequency domain may be rewritten as $$X_{HFC}(f) = \sum_{i=1}^{N} \alpha_i (X_{LFC}(f) * X_{LFC}(f) * \ldots * X_{LFC}(f))_i + R_{HFC}(f) \quad (3)$$

where $(X*X* \ldots *X)_i$ represents the $i^{th}$ order convolution of X to itself; e.g., $(X*X* \ldots *X)_i = X*X$.

Working in the frequency domain offers several additional advantages. One advantage is that the model itself can be adapted to different frequency bands (i.e., a separate set of model parameters can be estimated and transmitted for different frequency regions, thereby reducing the overall estimation error). Furthermore, the convolution operation adds less to the decoder complexity than the power function. When the frequency domain representations are used, the model parameters may be estimated using exactly the same procedure as outlined above with the time domain representation.

In summary, in the extended embodiment of the present invention, the high-frequency component is represented as $$X_{HFC}(f) = \sum_{i=1}^{i=N} \beta_i X'_{LFC}(f - M - L) + R_{HFC}(f) \quad (4)$$

Wherein, in the first part of the present invention, $$X'_{LFC}(f) = X_{LFC}(f) \quad (4a)$$

and in the second (optional) part of the present invention, $$X'_{LFC}(f) = \sum_{i=1}^{N} (X_{LFC}(f) * X_{LFC}(f) * \ldots * X_{LFC}(f)) \quad (4b)$$

It should be noted that the non-linear part is a beautification/refinement and is not "essential" to the invention. Therefore, various embodiments can be envisioned, depending on the processing power available.

Figure 5:
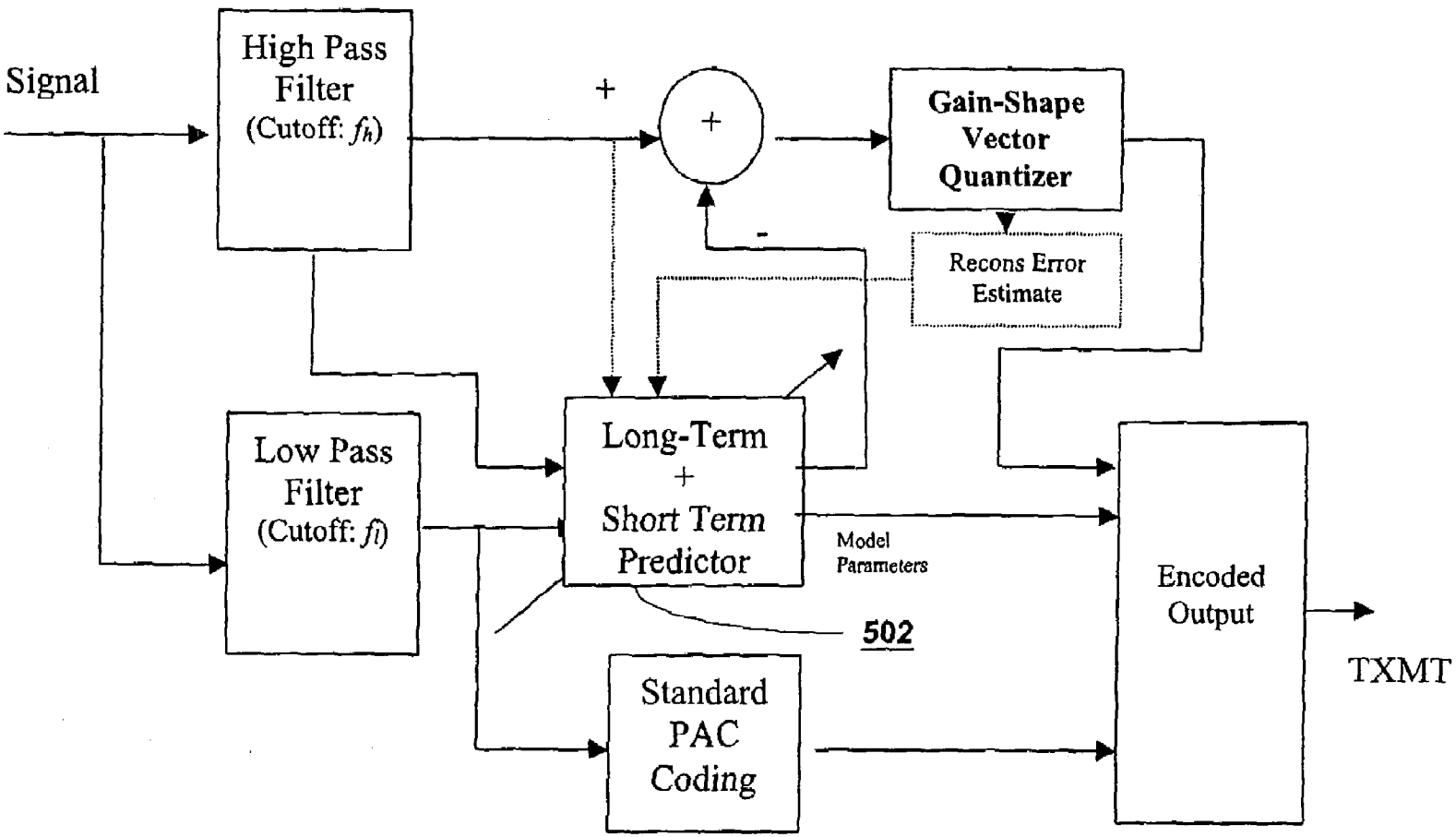
FIG. 5 illustrates an extended embodiment of the present invention wherein the reconstruction error or residual R(f) is coded separately using a PAC coder.

In this coding scheme, model parameters are estimated as above. In addition, the model reconstruction error or residual R(f) is coded separately using either (i) conventional PAC coding scheme or (ii) using efficient vector quantization techniques. Assuming a high degree of model fit, the resulting residual is significantly less complex to encode, thus requiring lesser number of bits to encode than the original high frequency component. A modified scheme is illustrated in FIG. 5, wherein long term and short term predictors 502 are used instead of the non-linear model in FIG. 4. This corresponds to equation 4(a). In one possible embodiment, $R_{HFC}(f)$ is quantized using a "gain-shape" random codebook.

Audio signal content can have a wide array of characteristics that change over time, e.g., from speech only, to voice over music, to all genres of music. Most compression algorithms allow for a single method of compression to be used, i.e., transform based, model based, etc. However, this does not capture the time-varying nature of audio, nor does it contain the capability of representing the audio efficiently. A flexible content-based compressed audio bitstream header allows the processing to change along with the audio signal. Improvements in the overall audio quality and interoperability between systems are achieved by allowing the systems to choose compression mechanisms "on-the-fly" and transmit the processing state via the bitstream header.

A flexible content-based compressed audio bitstream header allows the system to produce additional coding gains by changing or using a combination of algorithms that produces the best compression ratio while maintaining a high-level of subjective audio quality. That compression mechanism can then be determined "on-the-fly" and transmitted via the header at playback time. The type of features which may be adaptively chosen include techniques such as lattice quantization of scale factors, multidimensional coding of the peaks, and selection of a frequency range most amenable towards efficient high frequency coding.

Figure 7:
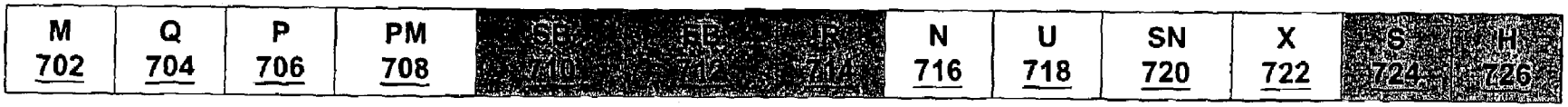
FIG. 7 illustrates the various fields in the header content of the bitstream.

A general description of the header content of the PAC V4 bitstream is described in this section. Each field of the header provides information from the encoder to the decoder on what processing to perform while reconstructing a frame of compressed audio data. FIG. 6 illustrates a table describing the functionality associated with the fields in the header content of the bitstream. FIG. 7 on the other hand illustrates the various fields associated with the header content of the bitstream and the order in which the fields are expected to occur. It should be noted that the white fields are always read, while the grey fields are conditionally read. The bits that follow are required to reconstruct the audio as indicated by status of the header bits. A different combination of header bits allows for a wealth of content specific compression schemes to be uses as required. A brief description of the fields are given below:

M (Mono) Field 702—This 1-bit field defines if one or two channels are to be decoded to produce stereo outputs. If the value of this field is "0", then two channel are to be decoded ("stereo"), and if the value of this field is "1", then only one channel is decoded ("mono").

Q (Huffman Scale Factor Lattice Quantization) 704—This 1-bit field defines which codebooks to use to decode the Huffman scale factors. If the value of this field is "0", then non-lattice codebooks are used; and if the value of this field is "1", then lattice codebooks are used.

P (Multi-dimensional Peaks) 706—This 1-bit field defines whether to decode the spectrum peaks using the multidimensional (MD) peaks codebook. Thus, a value of "1" in this field decodes the spectrum peaks using MD peaks codebook, and a value of "0" in this filed decodes the spectrum using non-MD peaks codebook.

PM (Prediction Mode) 708—This 2-bit defines if high frequency prediction will be used and what method will be implemented (e.g., a value of "00" corresponds to a unused field; a value of "01" corresponds to a recursive prediction mode; a value of "10" corresponds to a non-recursive prediction mode; and a value of "11" corresponds to a spread/conv prediction mode.

SB (Start Bin) 710—This 2-bit indicates at what frequency bin the high frequency prediction should begin.

EB (End Bin) 712—This 2-bit indicates at what frequency bin the high frequency prediction should end.

R (Residue Coding) 714—This 1-bit field defines whether to decode the high frequency residue if it has been included. A value of "0" indicates no residue, and therefore no decoding is necessary. On the other hand, a value of "1" indicates a residue and thus requires residue coding.

N (Non-Linear Companding) 716—This 1-bit field defines whether or not to perform non-linear companding. A value of "0" indicates no companding, and a value of "1" indicates companding.

U (Unsampling) 718—This 1-bit field indicates whether or not to upsample and compand audio data.

SN (Sequence Number) 720—This 2-bit field indicates if there is a different sequence set exists for different upsampling ratios.

X (Expansion) 722—This 1-bit field provides for future upgrades and backwards compatibility. If the bit is set, it is interpreted to be the S bit and indicates additional data.

S (Stereo High Frequency Coding) 724—This bit indicates that the high frequency content is stereo. A value of "0" indicates that stereo coding is not necessary and a value of "1" indicates that stereo coding is necessary.

H (HF Stability) 726—This 1-bit field indicates whether or not to use the stable parameters for the recursive prediction mode.

It should be noted that the Shaded fields (SB 710, EB 712, R 714, S 724, and H 726) in FIG. 7 are conditionally read unlike the rest of the fields which are unconditionally read. Thus, the SB 710, EB 712, and R 714 fields are read only when the value of PM field 708 is greater than 0. The S field 724 on the other hand is read only when the X field 722 is equal to 1, and similarly, the H field 726 is read only when the S field 724 is equal to 1.

The present invention incorporates a computer program code based product, which is a storage medium having program code stored therein, which can be used to instruct a computer to perform any of the methods associated with the present invention. The computer storage medium includes any of, but not limited to, the following: CD-ROM, DVD, magnetic tape, optical disc, hard drive, floppy disk, ferroelectric memory, flash memory, ferromagnetic memory, optical storage, charge coupled devices, magnetic or optical cards, smart cards, EEPROM, EPROM, RAM, ROM, DRAM, SRAM, SDRAM, or any other appropriate static or dynamic memory, or data storage devices.

Implemented in computer program code based products are software modules for: extracting low-frequency components of said signal; receiving said extracted high and low frequency components and producing a set of linear predictive filter coefficients by modeling said high frequency components as a function of low frequency components, said function given by either:

$$X_{HFC}(f) = \sum_{i=1}^{N} \beta_i X_{LFC}(f - M - i) + R_{HFC}(f),$$

or, $$X_{HFC}(f) = \sum_{i=1}^{N} \alpha_i (X_{LFC}(f) * X_{LFC}(f) * \ldots * X_{LFC}(f))_i + R_{HFC}(f)$$

or a combination of the above two functions, wherein $(X*X*\ldots*X)_i$ represents the $i^{th}$ order convolution of X onto itself; $X_{HFC}(f)$ and $X_{LFC}(f)$ denote the frequency transform of said high and low frequency components respectively; M is the optimum correlation lag; N represents the model order; encoding said extracted low-frequency components, and multiplexing said set of linear predictive filter coefficients and said encoded contents and forming an encoded output signal.

A system and method has been shown in the above embodiments for the effective implementation of an efficient coding of high frequency signal information in a signal using non-linear prediction based on a low pass baseband. The above system and method may be implemented in various computing environments. For example, the present invention may be implemented on a conventional IBM PC or equivalent, multi-nodal system (e.g., LAN) or networking system (e.g., Internet, WWW, wireless web). All programming and data related thereto are stored in, computer memory, static or dynamic, and may be retrieved by the user in any of: conventional computer storage, display (i.e., CRT) and/or hardcopy (i.e., printed) formats. The programming of the present invention may be implemented by one of skill in the art of digital signal processing.

While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by the order of the tap filter used, number of fields in the bitstream header, software/program, computing environment, or specific hardware.

The invention claimed is:

1. A system for efficiently coding signal information via predictors, said system comprising:

a) a high-pass filter extracting high-frequency components of said signal;

b) a low-pass filter extracting low-frequency components of said signal;

c) linear and non-linear predictors used in modeling a parametric representation of said high frequency components of said signal, said high frequency component modeled as:

$$X_{HFC}(f) = \sum_{i=1}^{N} \beta_i X'_{LFC}(f - M - i) + R_{HFC}(f),$$

wherein, in case of said linear predictor, $X'_{LFC}(f)=X_{LFC}(f)$ and in case of said non-linear predictor, $$X_{LFC}(f) = \sum_{i=1}^{N} (X_{LFC}(f) * X_{LFC}(f) * \ldots * X_{LFC}(f))_j,$$

and d) an encoder encoding said extracted low-frequency components and parameters associated with said linear and non-linear predictors.

2. A system as per claim 1, wherein said system further comprises a quantizer for quantizing said reconstruction estimate $R_{HFC}(f)$ based upon one or more codebooks.

3. A system as per claim 2, wherein said codebook is a gain-shape random codebook.

4. A system as per claim 1, wherein N is obtained by estimating the minimum approximation error over a small range of N and then choosing N for which optimal approximation error is minimized.

5. A system as per claim 1, wherein said high and low frequency components are obtained via windowing an appropriate range of frequencies in said signal.

6. A system as per claim 1, wherein said encoder is a perceptual audio encoder.

7. A system as per claim 1, wherein an encoding algorithm associated with said encoder is adaptively chosen from one or more encoding algorithms based upon which of said algorithms provides the best compression ratio.

8. A system as per claim 7, wherein a processing state identifying said adaptively chosen encoding algorithm is transmitted as a part of said encoded output signal via a bitstream header.

9. A system as per claim 7, wherein said encoder adaptively chooses any of the following features for efficient high frequency coding: lattice quantization of scale factors, multidimensional coding of peaks, or frequency range.

10. A system for efficiently coding signal information, said system comprising:

a) a high-pass filter extracting high-frequency components of said signal;

b) a low-pass filter extracting low-frequency components of said signal;

c) predictors for eliminating interharmonic frequency correlation in said signal by modeling said high frequency components of said signal via linear predictors;

d) non-linear predictors for modeling said high frequency components of said signal via a parametric representation using a non-linear predictor model; and e) an encoder encoding said extracted low-frequency components and parameters associated with said linear predictors.

11. A system as per claim 10, wherein said non-linear predictor model is given by:

$$X_{HFC}(f) = \sum_{i=1}^{N} \beta_i X'_{LFC}(f - M - i) + R_{HFC}(f),$$

wherein $$X_{HFC}(f) = \sum_{i=1}^{N} \beta_i X'_{LFC}(f - M - i) + R_{HFC}(f),$$

and said encoder further encoding parameters associated with said non-linear predictors.

12. A system as per claim 11, wherein said system further comprises a quantizer for quantizing said reconstruction estimate $R_{HFC}(f)$ based upon one or more codebooks.

13. A system as per claim 12, wherein said codebook is a gain-shape random codebook.

14. A system as per claim 10, wherein N is obtained by estimating the minimum approximation error over a small range of N and then choosing N for which optimal approximation error is minimized.

15. A system as per claim 10, wherein said high and low frequency components are obtained via windowing an appropriate range of frequencies in said signal.

16. A system as per claim 10, wherein said encoder is a perceptual audio encoder.

17. A system as per claim 10, wherein said encoder utilizes an encoding algorithm, and wherein said encoding algorithm is adaptively chosen from one or more encoding algorithms based upon which of said algorithms provides the best compression ratio.

18. A system as per claim 17, wherein a processing state identifying said adaptively chosen encoding algorithm is transmitted as a part of said encoded output signal via a bitstream header.

19. A system as per claim 17, wherein said encoder adaptively chooses any of the following features for efficient high frequency coding: lattice quantization of scale factors, multidimensional coding of peaks, or frequency range.

20. A system per claim 10, wherein said high frequency component is modeled as:

$$X_{LFC}(f) = \sum_{j=1}^{N} (X_{LFC}(f) * X_{LFC}(f) * \ldots * X_{LFC}(f))_j,$$

21. A method for efficiently coding signal information, said method comprising the steps of:

a) extracting high-frequency components of said signal;

b) extracting low-frequency components of said signal;

c) modeling a parametric representation of said high frequency components of said signal with linear and non-linear predictors, said high frequency component modeled as:

$$X_{HFC}(f) = \sum_{i=1}^{N} \beta_i X'_{LFC}(f - M - i) + R_{HFC}(f),$$

wherein, in case of said linear predictor, $$X'_{LFC}(f)=X_{LFC}(f)$$

and in case of said non-linear predictor, $$X'_{LFC}(f)=\sum_{j=1}^{N}(X_{LFC}(f)*X_{LFC}(f)*\ldots*X_{LFC}(f))_j,$$

and d) encoding said extracted low-frequency components and parameters associated with said linear and non-linear predictors.

22. A method as per claim 21, wherein N is obtained by estimating the minimum approximation error over a small range of N and then choosing N for which optimal approximation error is minimized.

23. A method as per claim 21, wherein said high and low frequency components are obtained via windowing an appropriate range of frequencies in said signal.

24. A method as per claim 21, wherein said encoding is done via a perceptual audio encoder.

25. A method as per claim 21, wherein said method further comprises the step of adaptively choosing an encoding algorithm from one or more encoding algorithms based upon which of said algorithms provides the best compression ratio.

26. A method as per claim 25, wherein said method further comprises the step of transmitting a processing state identifying said adaptively chosen encoding algorithm is transmitted as a part of said encoded output signal via a bitstream header.

27. An article of manufacture comprising a computer usable medium having computer readable program code embodied therein for efficiently coding signal information, said medium comprising:

a) computer readable program code extracting high-frequency components of said signal;

b) computer readable program code extracting low-frequency components of said signal;

c) computer readable program code modeling a parametric representation of said high frequency components of said signal with linear and non-linear predictors, said high frequency component modeled as:

$$X_{HFC}(f)=\sum_{i=1}^{N}\beta_i X'_{LFC}(f-M-i)+R_{HFC}(f),$$

wherein, in case of said linear predictor, $$X'_{LFC}(f)=X_{LFC}(f)$$

and in case of said non-linear predictor, $$X_{LFC}(f)=\sum_{j=1}^{N}(X_{LFC}(f)*X_{LFC}(f)*\ldots*X_{LFC}(f))_j,$$

and d) computer readable program code encoding said extracted low-frequency components and parameters associated with said linear and non-linear predictors.

28. The article of manufacture as per claim 27, wherein N is obtained by estimating the minimum approximation error over a small range of N and then choosing N for which optimal approximation error is minimized.

29. The article of manufacture as per claim 27, wherein said high and low frequency components are obtained via windowing an appropriate range of frequencies in said signal.

30. The article of manufacture as per claim 27, wherein said encoding is done via a perceptual audio encoder.

31. The article of manufacture as per claim 27, wherein said article further comprises computer readable program code for adaptively choosing an encoding algorithm from one or more encoding algorithms based upon which of said algorithms provides the best compression ratio.

32. The article of manufacture as per claim 31, wherein said article further comprises computer readable program code for transmitting a processing state identifying said adaptively chosen encoding algorithm transmitted as a part of said encoded output signal via a bitstream header.

* * * * *